US008294566B2

(12) United States Patent
Morwood et al.

(10) Patent No.: US 8,294,566 B2
(45) Date of Patent: Oct. 23, 2012

(54) EMERGENCY WARNING SYSTEM AND METHOD OF INSTALLATION

(75) Inventors: Kevin Lee Morwood, Richmond Hill (CA); Stefan Georg Hax, Pickering (CA)

(73) Assignee: Escherlogic Inc., Pickering (CA)

( * ) Notice: Subject to any disclaimer, the term of this patent is extended or adjusted under 35 U.S.C. 154(b) by 538 days.

(21) Appl. No.: 12/434,249

(22) Filed: May 1, 2009

(65) Prior Publication Data

US 2009/0273463 A1 Nov. 5, 2009

Related U.S. Application Data

(60) Provisional application No. 61/049,919, filed on May 2, 2008.

(51) Int. Cl.
*G08B 29/00* (2006.01)

(52) U.S. Cl. ..... 340/514; 340/506; 340/3.1; 340/539.1

(58) Field of Classification Search ..... 340/514, 340/506, 507, 511, 3.1
See application file for complete search history.

(56) References Cited

U.S. PATENT DOCUMENTS

| | | | | |
|---|---|---|---|---|
| 4,206,449 | A | 6/1980 | Galvin et al. | |
| 5,400,246 | A * | 3/1995 | Wilson et al. | 700/17 |
| 6,243,001 | B1 | 6/2001 | Kodaka | |
| 6,288,637 | B1 * | 9/2001 | Thomas et al. | 340/506 |
| 6,624,750 | B1 * | 9/2003 | Marman et al. | 340/506 |
| 7,081,827 | B2 | 7/2006 | Addy | |
| 2002/0041499 | A1 | 4/2002 | Pederson | |
| 2002/0055977 | A1 | 5/2002 | Nishi | |
| 2007/0046455 | A1 | 3/2007 | Farley et al. | |
| 2007/0054618 | A1 | 3/2007 | Lewis et al. | |
| 2007/0115208 | A1 | 5/2007 | Moulis, Jr. et al. | |

FOREIGN PATENT DOCUMENTS

| | | | |
|---|---|---|---|
| EP | 1762996 | A1 | 3/2007 |
| EP | 1764947 | A2 | 3/2007 |
| WO | WO 02/37443 | A1 | 5/2002 |

* cited by examiner

*Primary Examiner* — Daryl Pope

(57) ABSTRACT

An emergency warning system includes a plurality of emergency annunciators for installation in a physical zone, a zone controller and a master controller. Each emergency annunciator is operable to independently and periodically perform a self-test for verifying its capacity to annunciate an emergency and to transmit a report of the self-test result. The zone controller is operable to receive the reports from each emergency annunciator and generate and transmit a zone report representing a consolidation of the received reports. The zone controller can also transmit an activation command to the emergency annunciators based on a received zone activation command. A master controller is operable to receive the zone report and generate therefrom a user notification indicative of the self-test results as well as to transmit the zone activation command in response to a trigger condition. The system may be easily installable through addition of the above components to an existing computer networking infrastructure.

21 Claims, 8 Drawing Sheets

Mapping 62

| | I | II | III | |
|---|---|---|---|---|
| | EMERGENCY ANNUNCIATORS | | | 300 |
| | MAC Address | IP Address | Parent Zone Controller | |
| Zone 1 | A | 10.2.3.4 | 10.2.3.254 | 304 |
| Zone 1 | B | 10.2.3.5 | 10.2.3.254 | 306 |
| Zone 1 | C | 10.2.3.6 | 10.2.3.254 | 308 |
| Zone 2 | D | 10.2.5.4 | 10.2.5.254 | 310 |
| Zone 2 | E | 10.2.5.5 | 10.2.5.254 | 312 |
| Zone 2 | F | 10.2.5.6 | 10.2.5.254 | 314 |
| | ZONE CONTROLLERS | | | 320 |
| | MAC Address | IP Address | Parent Zone Controller | |
| | H | 10.2.3.254 | 10.2.254.254 | 322 |
| | I | 10.2.5.254 | 10.2.254.254 | 324 |
| | ZONE TRIGGERS | | | 330 |
| | MAC Address | IP Address | Parent Master Controller | |
| | K | 10.3.1.1 | 10.2.254.254 | 332 |
| | L | 10.3.1.2 | 10.2.254.254 | 334 |
| | M | 10.3.1.3 | 10.2.254.254 | 336 |
| | MASTER CONTROLLER | | | 340 |
| | MAC Address | IP Address | Parent Master Controller | |
| | J | 10.2.254.254 | - | 342 |
| | INTER - HEARTBEAT DELAY PERIOD | | | 350 |
| | 15 seconds | | | 352 |

FIG. 3

Scratchpad 700

Time:125

| | I | II | III | IV | | |
|---|---|---|---|---|---|---|
| | EA# | LAST HEARTBEAT RECEIVED AT? | ON/OFF | ALARMS | | |
| | | | | CONDITION 1 | ... | CONDITION N |
| 710 | 30 | 120 | 0 | 0 | ... | 0 |
| 712 | 32 | 121 | 1 | 0 | ... | 0 |
| 714 | 34 | 125 | 0 | 1 | ... | 0 |
| | ⋮ | ⋮ | ⋮ | ⋮ | ⋮ | ⋮ |

FIG. 7A

Scratchpad 700

Time:136

| | I | II | III | IV | | |
|---|---|---|---|---|---|---|
| | EA# | LAST HEARTBEAT RECEIVED AT? | ON/OFF | ALARMS | | |
| | | | | CONDITION 1 | ... | CONDITION N |
| 710 | 30 | **135** | **1** | 0 | ... | 0 |
| 712 | 32 | **136** | 1 | 0 | ... | 0 |
| 714 | 34 | 125 | 0 | 1 | ... | 0 |
| | ⋮ | ⋮ | ⋮ | ⋮ | ⋮ | ⋮ |

FIG. 7B

EMERGENCY WARNING SYSTEM AND METHOD OF INSTALLATION

CROSS-REFERENCE TO RELATED APPLICATIONS

This application claims the benefit of U.S. Provisional Application No. 61/049,919, filed May 2, 2008, the contents of which are hereby incorporated by reference.

FIELD OF TECHNOLOGY

The present disclosure relates to emergency warning systems and to the installation thereof.

BACKGROUND

In any institution, body or organization having a physical premises (i.e. land and one or more buildings thereupon), an emergency situation may unexpectedly arise that may endanger the safety of persons on the premises. Examples of institutions, bodies or organizations include schools, colleges, universities, businesses, high-rises, shopping malls, amusement parks, transportation systems, governmental bodies, neighborhoods and municipalities. Examples of emergency situations include armed persons at large, imminent or actual terrorist attack, criminal activity, and chemical/biological/radiation contamination. In such situations, it is usually desirable for persons on the premises to be notified of the emergency situation as soon as possible so that they may take precautions, such as seeking cover, staying in a safe area, or locking doors. This notification may be referred to as notifying occupants of a "lockdown" state.

A reliable system for facilitating the issuance of emergency warnings would be desirable. A method for conveniently installing such a system would also be desirable.

SUMMARY

In accordance with one aspect of the present disclosure there is provided an emergency warning system comprising: a plurality of emergency annunciators for installation in a physical zone, each of said emergency annunciators being operable to independently and periodically perform a self-test for verifying its capacity to annunciate an emergency and to transmit a report of the self-test result; a zone controller in communication with each of said emergency annunciators, said zone controller being operable to receive said reports from each of said emergency annunciators and to generate and transmit a zone report representing a consolidation of the received reports, said zone controller further being operable to receive a zone activation command and to transmit, responsive thereto, an activation command to each of said emergency annunciators; and a master controller in communication with said zone controller, said master controller being operable to receive said zone report from said zone controller and to generate therefrom a user notification indicative of the self-test results, said master controller further being operable to transmit said zone activation command in response to a trigger condition.

In accordance with another aspect of the present disclosure there is provided in a computer network comprising a switch capable of switching network traffic and of providing electrical power for powering network devices connected to said switch, a method of installing an emergency warning system, the method comprising: plugging each of a plurality of emergency annunciators into said switch, each of said emergency annunciators being an electronic device operable to annunciate an emergency in response to an activation command received over said computer network via said switch and to independently and periodically perform a self-test for verifying its capacity to annunciate an emergency and to transmit a report of the self-test result over said computer network via said switch, said electronic device to be powered by electrical power provided by said switch; connecting a zone controller for controlling said plurality of emergency annunciators to said computer network or to another computer network in communication with said computer network, said zone controller operable to receive said reports from each of said emergency annunciators and to generate and transmit a zone report representing a consolidation of the received reports, said zone controller further being operable to receive a zone activation command and to transmit, responsive thereto, an activation command to each of said emergency annunciators; and activating a master controller for controlling said zone controller, said master controller being connected to said computer network or to another computer network in communication with said computer network, said master controller being operable to receive said zone report from said zone controller and to generate therefrom a user notification indicative of any problematic self-test results, said master controller further being operable to transmit said zone activation command in response to a trigger condition.

Other aspects and features of the present disclosure will become apparent to those ordinarily skilled in the art upon review of the following description of specific embodiments of the invention in conjunction with the accompanying figures.

BRIEF DESCRIPTION OF THE DRAWINGS

In the figures which illustrate at least one exemplary embodiment of this invention:

FIG. 3 illustrates an exemplary mapping that may be used to establish the hierarchical relationship between system components shown in FIG. 2;

FIGS. 7A and 7B are schematic illustrations of scratchpad values maintained at a zone controller component of the system of FIG. 1.

DETAILED DESCRIPTION

Figure 1:
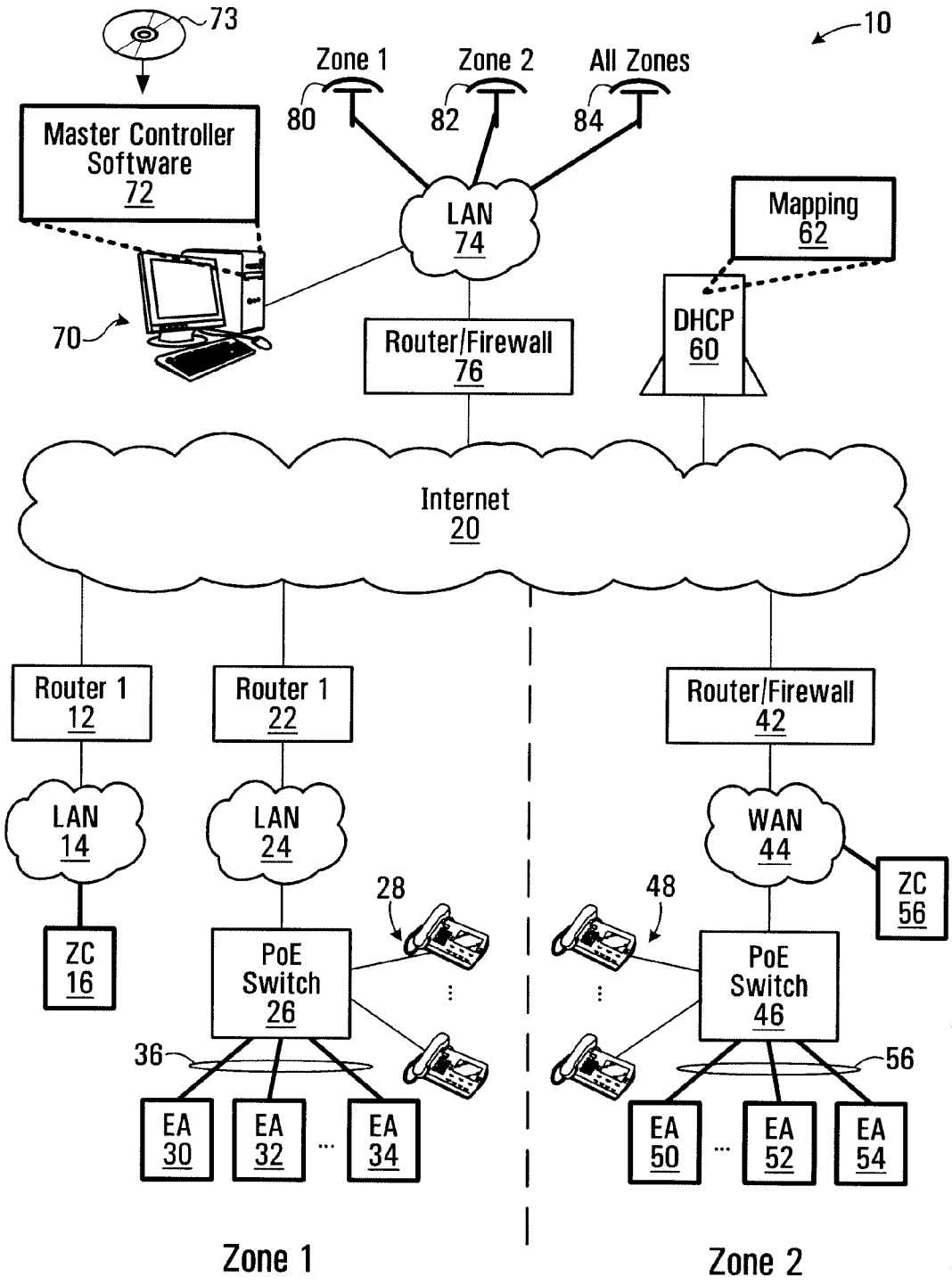
FIG. 1 is block diagram of an exemplary emergency warning system.

FIG. 1 is a block diagram illustrating an exemplary emergency warning system 10. For illustration, it is assumed that the system 10 has been installed for use by an institution, such as a college or university, whose physical premises consists of a downtown campus and a suburban campus. These two campuses are labelled "zone 1" and "zone 2" in FIG. 1. The designation of each campus as a "zone" within the system 10 is made during installation of the system, as will be described below.

The institution is presumed to have an existing computer networking infrastructure prior to the installation of the system 10, which serves to link the two zones in support of various information technology objectives (e.g. providing the institutional community with access to various resources such as the Internet, an intranet, email accounts and the like). Components illustrated in FIG. 1 using lines of normal weight represent this existing infrastructure. In contrast, components illustrated in FIG. 1 using heavier lines are components which have been added to the existing infrastructure in the context of installing the emergency warning system 10. Based on these conventions, it should be apparent that the existing infrastructure in FIG. 1 includes routers/firewalls 12, 22, 42 and 76, local area networks (LANs) 14, 24 and 74, WAN 44, Power over Ethernet (PoE) switches 26 and 46, Voice over Internet Protocol (VoIP) telephone equipment 28 and 48, Dynamic Host Control Protocol (DHCP) server 60, and computer 70. In contrast, the added components include zone controllers 16 and 56, emergency annunciators (EAs) 30, 32, 34, 50, 52 and 54, EA connections 36 and 56, mapping 62, master controller software 72, and zone triggers (ZTs) 80, 82 and 84. These components are described below in turn.

Beginning with the existing infrastructure, router/firewalls 12, 22, 42 and 76 are conventional routers with associated conventional firewalls. They are situated between the public Internet 20 and institutional networks 14, 24, 44 and 74, respectively. As is well-known in the art, the purpose of the firewall component is to deny unauthorized access to the networks 14, 24, 44 and 74 via the Internet 20. The routers/firewalls 12, 22, 42 and 76 may for example be Linksys™/Cisco™ WRT54GL routers and firewalls comprising Linux with Iptables.

LANs 14 and 24 are conventional local area networks providing computer network connectivity within zone 1. The LANs 14 and 24 are primarily intended for interconnecting various types of network devices, such as computers, servers and/or workstations of various types, as is typically done in a college or university setting. This may be in order to support the various information technology objectives identified above. Accordingly, the data that is carried on LANs 14, 24 of the present example conforms to the Transmission Control Protocol (TCP)/IP protocol suite. In the illustrated example, each of LANs 14 and 24 is an Ethernet network. This is not necessarily true of all embodiments. LAN 74 is also an Ethernet network but is located in an area outside of zone 1 and zone 2. In the present example, LAN 74 provides Ethernet computer network access to an institutional security office, which may be located in either of the two campuses.

WAN 44 is a conventional wide area network interconnecting various computing devices within zone 2. A WAN may be employed (rather than, say, a LAN) due to the large size of zone 2 for example. In the present example, the WAN 44 carries TCP/IP data traffic.

PoE switches 26 and 46 are conventional switches capable of switching network traffic and of providing electrical power for powering network devices connected to the switch via any of a plurality of ports. The capacity for providing electrical power to connected devices allows certain equipment, such as VoIP telephone equipment 28 and 48 (described below), to continue to be operable even during a power failure when the PoE switches are used in conjunction with a conventional Uninterruptable Power Supply (not illustrated). In the present example, power is delivered over 10/100 Ethernet ports using the IEEE 802.3af standard, which standard is hereby incorporated by reference hereinto. The PoE switches 26 and 46 may for example be Linksys™ SFE2000P, 3Com™ switch 4500 PWR, Dell™ 3424P or Dell 3448P PoE switches.

Voice over Internet Protocol (VoIP) telephone equipment 28 and 48 comprises sets of IP telephones that permit voice communication to occur over IP networks using, e.g., the ITU-T H.323 standard. Each telephone receives electrical power and transmits/receives data packets representing voice over a single connection with its respective PoE switch 26 or 46. The connection may for example be a "Cat5e" cable complying with the ANSI/TIA/EIA-568-B.1-2001, -B.2-2001, and/or -B.3-2001 standard, as promulgated by the Telecommunications Industry Association, terminating in well-known 8 Position 8 Contact (8P8C) or RJ-45 modular connectors. The IP telephones 28, 48 are capable of calling other IP telephones (e.g. other ones of IP telephones 28, 48) or conventional telephones via the public switch telephone network (PSTN), using conventional techniques. Equipment 28 and 48 is illustrated in FIG. 1 primarily to show the rationale for having PoE switches 26 and 46 within the existing infrastructure of FIG. 1.

DHCP server 60 is a server that is responsible for assigning IP addresses to various network devices in the system of FIG. 1, including components during the installation of emergency warning system 10 (as described below), using the DHCP protocol. The operative DHCP protocol may be as defined by Request For Comments (RFC) 2131 or as proposed in RFC 3315 for example. These RFCs are currently available at www.ietf.org/rfc/rfc2131.txt and www.ietf.org/rfc/rfc3315.txt and are incorporated by reference hereinto. As will become apparent, the IP addresses assigned to components of system 10 using DHCP are user-configurable, e.g. by a system administrator, within mapping 62 (defined below) and facilitate the creation of a hierarchy of components within system 10 by which emergency notification is performed. The DHCP server 60 is hosted at, or constitutes, a network device.

Computer 70 is a conventional computer having a processor, memory, keyboard/mouse and display (e.g. a desktop or laptop computer) that is connected to LAN 74 via a network interface. In the present example, the computer 70 is accessible to, and only used by, security personnel at the institutional security office. A purpose of computer 70, at least in part, may be to provide security personnel with Internet, intranet and email access. The network interface of computer 70 implements the TCP/IP protocol suite. As will be apparent, the computer 70 is used within system 10 to execute master controller software 72 (described below) that is installed thereupon during the installation of the system 10. The software 72 adapts the computer 70 for use in controlling the emergency warning system 10 from the security office. The computer 70 executing the master controller software 72 may be referred to as "master controller 70". The term "master controller" may alternatively be used to refer to the software 72.

Turning to the components of FIG. 1 that are added during the installation of the emergency warning system 10, zone controllers 16 and 56 are essentially dedicated computers programmed primarily to perform two functions. First, each zone controller 16 and 56 controls a set of emergency annunciators within its designated zone by relaying activation, deactivation or other commands originating from the master controller software 72 (described below) to the EAs. Zone controller 16 controls EAs 30, 32, 34 of zone 1 while Zone Control 56 controls EAs 50, 52, 54 of Zone 2. The EAs that are controlled by a zone controller are referred to as the "children" of the zone controller, which accordingly may be referred to as their "parent". Second, each zone controller receives periodic reports from each of its children EAs regarding the capacity of the EA to annunciate an emergency, consolidates the reports into a "zone report", and transmits the zone report back to the master controller software 72. The zone reports serve to provide master controller 70 with a periodic indication of the capacity of system 10 to reliably annunciate an emergency in each zone. A zone report from a zone controller also reflects any failure of the zone controller to receive a report from one (or more) of its children EAs for at least a predetermined time period, which may result due to failure of the EA or failure the channel of communication between the EA and the zone controller. The relationship between the zone controllers and zones in the present embodiment is one-to-one, although it could be one-to-many in alternate embodiments (as described later).

Each exemplary zone controller 16, 56 is a single-board computer having a processor, volatile and non-volatile memory, and a network interface having connectors for convenient network interconnectivity. The computer may include other components. The processor may for example be an Atmel™ AT32AP7000 CPU executing the Linux™ operating system, e.g. Linux kernel 2.6.18 or better. The network interface permits the zone controllers 16 and 56 to communicate over LAN 14 and WAN 44, respectively, using the TCP/IP protocol suite. Each zone controller 16, 56 of the present embodiment also implements the HyperText Transfer Protocol (HTTP) suite to facilitate communications between itself and its children EAs, to ensure that communication can occur even if the EAs are behind a firewall. The software executed by the zone controller may be likened to a world wide web server that has been configured to provide information specific to each EA that it controls upon the request of the EA.

Emergency annunciators (EAs) 30, 32, 34, 50, 52 and 54 are microprocessor-driven electronic devices have two primary functions. First, each EA is operable to annunciate an emergency, e.g. by illuminating a sign spelling out the words "LOCK DOWN", upon receipt of an activation command from its parent zone controller (and to cease annunciation upon receipt of a deactivation command). Second, each EA periodically initiates a self-test for verifying its capacity to annunciate an emergency and transmits a report of the self-test result to its parent zone controller. This is in support of the objective of continually keeping the master controller 70 aware of the capacity of the system 10 to reliably annunciate an emergency. The EA also periodically sends a predetermined "heartbeat" message to its parent zone controller. This is simply to indicate that the EA is on-line. Failure to receive an expected heartbeat message at the zone controller serves as an indicator of a breakdown in the channel of communication between the relevant EA and its parent zone controller or a problem with the EA itself. The interval between heartbeat messages is configurable through the master controller software 72 (described below) and may for example be more frequent than self-test reports (e.g. every 15 seconds for heartbeat messages versus every hour for self-test reports).

Physically, the electronic device comprising each EA may have a size and shape similar to a conventional "EXIT" sign and may be encased in polycarbonate plastic to reduce the likelihood of tampering. The size and shape of the EA may differ in alternate embodiments, however the general intent is to be able to mount the EA to the wall or otherwise display it in a prominent location where it will be seen by human observers. A single connector situated at the center of a back (wall-mountable) side of the EA may constitute the only external connector of the EA. This sole connector serves a dual role: it provides for computer network connectivity and it provides a source of electrical power for powering the EA. The EA of the present embodiment draws electrical power in accordance with the IEEE 802.3af standard, with which the PoE switches 26, 46 (described above) also comply. The single connector provides ease of interconnection of the EAs and may reduce susceptibility to tampering, e.g. as compared to a device having separate external power and data connectors. The connector is an RJ-45 port in the present embodiment.

Each EA also includes a circuit of multiple light-emitting diodes (LEDs) connected in series and physically arranged (e.g. mounted to a printed circuit board) to spell out the words "LOCK DOWN". The series connection facilitates the capacity of the EA to perform a self-test: if a continuity test of the circuit fails, the EA is assumed to be incapable of annunciating an emergency. Additional circuitry within each EA, including an inductive charge pump, facilitates the use of PoE electrical power for illuminating the LEDs so that their brightness will be sufficient for visibility (e.g. up to 2800 mcd per LED) and varies sinusoidally when the EA is active. Other forms of illuminable text (e.g. a controlled light source behind text formed using a combination of transparent and opaque materials) could be used in the EAs of alternative embodiments.

In the present embodiment, all communications between each EA and its zone controller are by way of an HTTP request initiated by the EA and a corresponding HTTP response from the zone controller. For example, the HTTP request may contain the report of a self-test result or may constitute the heartbeat message while the HTTP response may contain an activation (or deactivation) command if emergency annunciation is presently active (or has been cleared). As will become apparent, this approach ensures that the zone controller can command its children EAs even when the EAs are behind a firewall and the zone controller is outside of the firewall. To support the above operation, each EA of the present embodiment implements the HTTP and TCP/IP protocol suites. The HTTP response may contain other types of commands destined for the EA, such as commands instructing the EA to reset itself or to initiate a self-test immediately, in response to heartbeat messages, as will be described.

Figure 2:
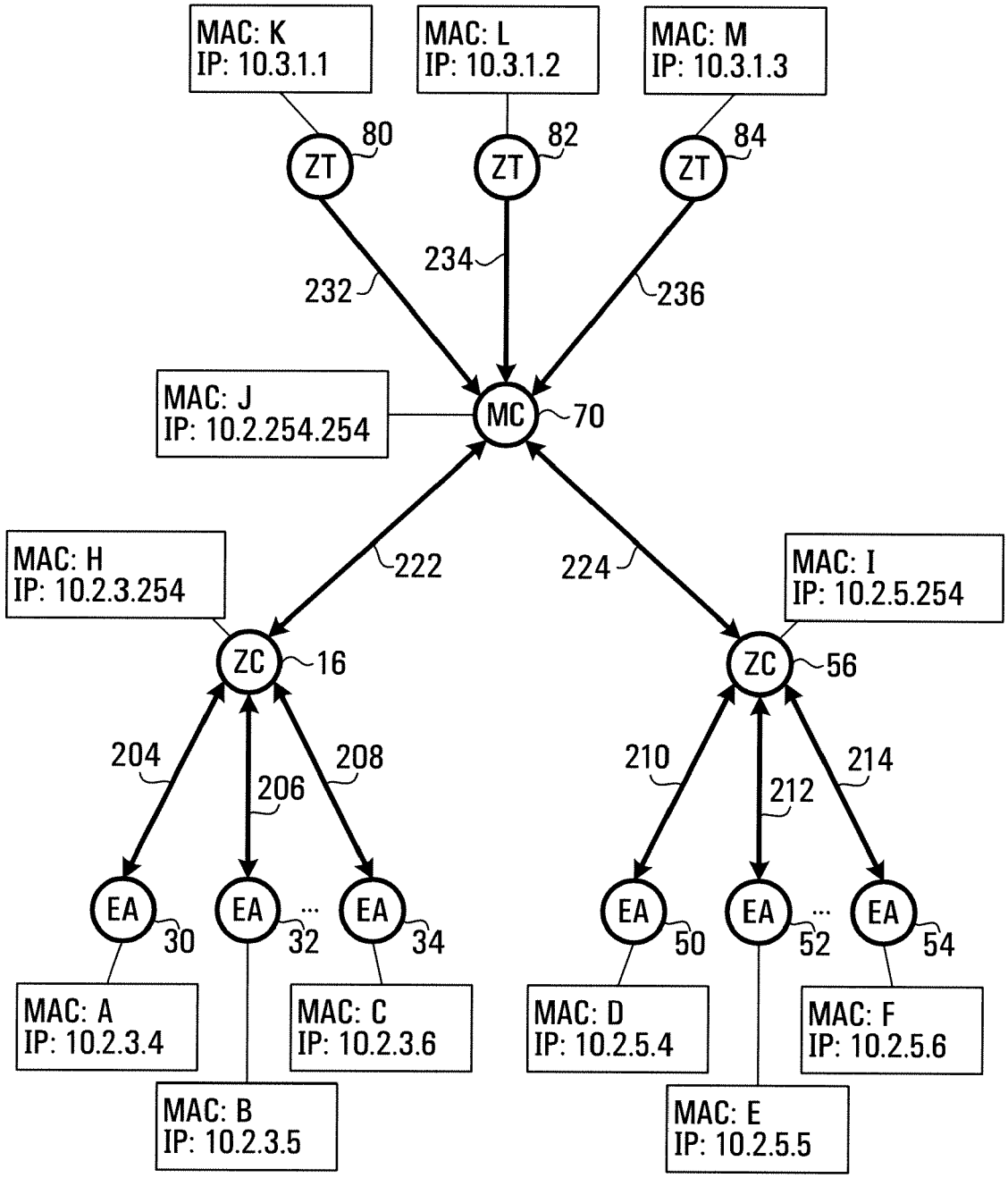
FIG. 2 is a schematic view of the hierarchical relationship between various components of the system of FIG. 1.

Mapping 62 is a data structure stored within the memory of DHCP server 60, possibly in the form of an electronic file. The mapping 62 defines a hierarchical or tree relationship for communication between the master controller 70, the zone controllers 16 and 56, and EAs 30, 32, 34 and 50, 52 and 54 within system 10 during system operation. An exemplary hierarchy 200 that can be defined within mapping 62 is shown in FIG. 2. Referring to FIG. 2, circular tree nodes represent each of master controller 70, the zone controllers 16 and 56, and EAs 30, 32, 34 and 50, 52 and 54, as well as zone triggers 80, 82 and 84 (described below) of FIG. 1. Branches interconnecting the nodes in FIG. 2 represent channels of communication between the represented components that are created at run time over the existing infrastructure (e.g. computer networks, PoE switches, routers/firewalls, etc.) interconnecting the components shown in FIG. 1. Branches in FIG. 2 that are illustrated as bi-directional arrows represent bi-directional communication channels, whereas branches illustrated as unidirectional arrows represent unidirectional communication channels.

It will be appreciated that the communication channel represented by each branch shown in FIG. 2 is actually effected over numerous system components between the devices represented by the nodes at either end of the branch. For example, the communication channels represented by branches 204, 206 and 208 in FIG. 2 are each effected over PoE switch 26, LAN 24, router/firewall 22, Internet 20, router/firewall 12, and LAN 14 of FIG. 1. In contrast, the communication channels represented by branches 210, 212 and 214 of FIG. 2 are each effected over only PoE switch 46 and WAN 44 of FIG. 1. Branch 222 between zone controller 16 and the master controller 70 is effected over LAN 14, router/firewall 12, Internet 20 and router/firewall 74, while branch 224 between the other zone controller 56 and the master controller 70 is effected over WAN 44, router/firewall 42, Internet 20 and router/firewall 74. Finally, branches 232, 234 and 236 between the zone triggers 80, 82, 84 (respectively) and the master controller 70 are effected over only the LAN 74.

As shown in FIG. 2, the master controller 70 acts as the root node of the hierarchy 200, the zone controllers 16 and 56 act as next level nodes within the hierarchy 200, and EAs 30, 32, 34 and 50, 52 and 54 act as terminal nodes within the hierarchy 200. In the resultant three-level hierarchy, status reports regarding the capacity of the system 10 to reliably annunciate an emergency may be considered to flow "up" from the EAs towards master controller 70, while commands may be considered to flow "down" from the master controller 70 towards the EAs.

For clarity, nodes 80, 82 and 84 (representing zone triggers 80, 82 and 84, described below) may also be considered children of the root node 70. However, because communication is unidirectional from the zone triggers 80, 82 and 84 to the master controller 70, the nodes 80, 82 and 84 are illustrated in FIG. 2 as being above the root node. The unique MAC address (a form of hardware address) and IP address assigned to each node of hierarchy 200 is also shown in FIG. 2. As will be appreciated, the IP addresses are user-configurable and are used to define the mapping 62.

FIG. 3 illustrates in more detail an exemplary mapping 62 that results in the hierarchy 200 of FIG. 2. The content of FIG. 3 will be described below in the context of describing system installation.

Master controller software 72 is application software executable by computer 70 for the purpose of controlling the emergency warning system 10. The primary responsibilities of the master controller software 72 are twofold. First, it receives zone reports from each of zone controller 16, 56 and generates therefrom a user notification indicative of the self-test results. This user notification may take the form of a user interface displayed on the display of computer 70 providing an "at a glance" indication of the "health" of each of the zones, as described hereinafter, or it may take the form of email or Short Message Service (SMS) messages that are transmitted to one or more predetermined recipient addresses (e.g. to security officers). Second, the master controller software 72 is responsible for transmitting a zone activation command to either one or both of zone controllers 16 and 56 in response to a trigger condition. In the present embodiment, the trigger condition comprises receiving a message from one of zone triggers 80, 82 and 84 indicating that an emergency exists in zone 1, zone 2, or both (respectively). The master controller is also capable of sending other commands to one or both of zone controllers 16 and 56 in accordance with on-demand user input at computer 70, such as commands for causing the EAs in the relevant zone(s) to perform self-tests or to reset themselves.

Zone triggers 80, 82 and 84 are electronic trigger devices having buttons that, upon being depressed, send a message to the master controller to cause it to activate emergency annunciation in one or more zones. Zone triggers may be implemented in a similar fashion to EAs, thus the message may similarly be HTTP request messages (although no HTTP responses are sent in response to such messages). Also, instead of having LEDs for annunciating an emergency, zone triggers have buttons for signalling when an emergency situation has been detected. The zone triggers may be mounted on the wall of the institution's security office for example, so that they will only be accessible by security personnel. Each zone trigger may be labelled with the name of the zone in which emergency annunciation will be triggered by depression of its button (e.g. zone trigger 80 may be labelled "downtown campus", zone trigger 82 may be labelled "suburban campus", and zone trigger 84 may be labelled "all zones").

Installation of the system 10 of FIG. 1 begins with only the existing infrastructure components of FIG. 1 in place. The installer (e.g. an information technology (IT) technician or system administrator for the institution) initially considers the number of zones that should be defined for the institution. As alluded to above, a zone is a physical or geographical area for which emergency notification can be performed as a whole and, if desired, independently of other zones. The number of zones may be chosen based, at least in part, upon physical or geographical boundaries within the institution (campuses, buildings, departments etc.). In the present embodiment, the installer decides to define two zones, one for each of the downtown and suburban campuses of the institution. This necessitates the use of two zone controllers—one to control the EAs in each zone. In some embodiments, there may be more than one zone controller per zone; this possibility is discussed later.

Next the installer decides how many EAs to install within each zone. Factors that may impact upon the choice of a number of EAs to install may include the number of rooms in the zone (typically at least one EA is installed per room) and the size of each room in the zone (larger rooms may warrant more than one EA for visibility). In the present example, three EAs per zone are illustrated in FIG. 1. It will be appreciated that the number of EAs illustrated in FIG. 1 is merely illustrative and that, in many cases, the number of EAs per zone may be significantly larger than three (e.g. one hundred or more). The number of EAs need not be the same in each zone.

The installer also considers the subset(s) of zones for which it is desired to be able to annunciate an emergency independently of other zones. In many cases it will sufficient or required to be able to annunciate an emergency in each zone independently of other zones. This allows persons who may be in danger in a particular zone to be notified of an emergency without notifying the occupants of other zones, which might unnecessarily incite panic if those occupants are unlikely to be affected by the emergency. Alternatively, or in conjunction, it may be desirable to be able to annunciate an emergency in all zones at the same time, in order to provide the maximum degree of notification to persons institution-wide, regardless of precisely where within the institution the emergency has occurred. In the present example, it is assumed that the capacity for independent emergency annunciation in each zone is desired, but that the capacity for institution-wide emergency annunciation is also desired. On this basis it is decided to install three zone triggers: the first two zone triggers 80 and 82 are for annunciating an emergency in zone 1 and zone 2, respectively, while the last zone trigger 84 is for annunciating an emergency in all (i.e. both) zones. The third zone trigger 84 effectively serves as a more convenient mechanism for triggering notification in both of zones I and 2 than separate activation of zone triggers 80 and 82. In systems with numerous zones, zone triggers for annunciating emergencies in various subsets of zones, possibly overlapping with one another, could be implemented. The zone triggers are configured to indicate the zone(s) they will be triggering. This may for example involve configuring a data record or file stored at the zone triggers or changing a hardware setting such as dipswitch or the position of a jumper on a printed circuit board, to reflect the zone(s) to be triggered.

In the present embodiment, it is assumed that the installer chooses a configuration for system 10 in which the hierarchical relationship 200 between system components will be as illustrated in FIG. 2. This hierarchical relationship is effected by the installer in two ways. First, a mapping 62 (FIG. 1) is created to capture the desired hierarchical relationship between components. Second, the components represented by the nodes of hierarchy 200 are physically installed. These steps will be described in turn.

With regard to the first step, i.e. creating of mapping 62, an exemplary mapping 62 that has been created by the installer is illustrated in FIG. 3. The mapping 62 is generated by the master controller software 72 in the present embodiment, based on user input. The mapping is illustrated in FIG. 3 in table form. It will be appreciated that the titles and column headings of the table are to facilitate reader comprehension and do not actually appear within the mapping 62. In essence, mapping 62 defines the hierarchy 200 by assigning a unique IP address to each node within the hierarchy 200 (or more accurately, to each device represented by a node within hierarchy 200) and specifying, for each non-root node, the IP address of the node's parent within the hierarchy. In this manner, each node can learn the identity of its parent within the hierarchy 200 at run time. It will be appreciated that the content of mapping 62 reflects the number of zones, zone controllers and emergency annunciators within the system 10. Creation of the mapping 62 may be facilitated by the master controller software 72 based on user input through appropriate user interfaces.

The exemplary mapping 62 of FIG. 3 has four sections 300, 320, 330 and 340 containing mapping information for the emergency annunciators, zone controllers, zone triggers and master controller, respectively, of system 10 (FIG. 1). Each row within the table of FIG. 3 contains mapping information for a single device of the type indicated by the section heading. Each row has three columns. Column I contains the unique MAC address of the device. This MAC address may for example be typed in by the installer using a user interface of the master controller software 72, based on a paper label adhered to the relevant device (wherein the label may read "The MAC address of this device is X"). Alternatively, the labels may comprise barcode representations of the MAC address capable of being scanned by an optical scanner which may form part of the master controller 70. By scanning the label on each EA, typing may be avoided and generation of mapping 62 may be facilitated. The unique letters for each row in column I are used for ease of illustration and are understood to represent unique MAC addresses. The represented MAC addresses may actually be long identifiers conforming to, e.g., the IEEE-administered MAC-48, EUI-48™, or EUI-64™ numbering space formats. Column II contains a user-assigned IP address for the device whose MAC address is indicated in column I. Column III contains the IP address of the parent component for the device within hierarchy 200. The contents of the second and third columns may also be typed into mapping 62 by the installer, using a text editor or a user interface of the master controller software 72 designed for this purpose for example.

As is perhaps best seen in FIG. 2, the IP addresses assigned to each device in the present embodiment is such that the EAs within each zone share a subnet with their assigned zone controller. That is, the first three octets of the IP address for each EA in a zone is the same as that of the zone controller for that zone. For example, referring to section 320 of FIG. 3, the first three octets of the IP addresses assigned to the EAs and zone controller of zone 1 are 10.2.3 (see rows 304, 306, 308 and 322 of FIG. 3, column II). Similarly, the first three octets of the IP addresses assigned to the EAs and zone controller of zone 2 are 10.2.5 (see rows 310, 312, 314 and 324 of FIG. 3, column II). This is not required in all embodiments. A convention is also adopted in the present embodiment whereby the last octet of each zone controller's IP address is set to 254 (see FIG. 3, column II, rows 322 and 324). This is simply for installer convenience, so that an IP address of a zone controller may be easily identified. Alternative embodiments may assign IP addresses using other conventions. The parent of each zone controller is specified to be the master controller (see column II of rows 322 and 324).

Referring to section 330 of FIG. 3, it can be seen that the installer has assigned a unique IP address within a chosen subnet 10.3.1 to each of zone triggers 80, 82 and 84 (see column II of rows 332, 334 and 336) and that the parent of each zone trigger within hierarchy 200 is specified to be the master controller (see column III of those rows). Finally, in row 342 of FIG. 3, the IP address of the master controller is specified in column II. The lack of any entry within column III of row 342 reflects the status of the master controller as the root node of the hierarchy 200. Once the mapping 62 has been created, it may be loaded into the DHCP server 60 (FIG. 1).

As also shown in FIG. 3, mapping 62 further includes a section 350 storing a user-configurable inter-heartbeat delay period. This represents the amount of time that each EA should wait between successive heartbeat messages to its parent zone controller. The value is set to 15 seconds in row 352. This value may be configurable, e.g., through a user interface of master controller software 72. It may be possible to propagate a value changed after system installation to each EA within the system 10, as will be described.

The second above-noted step, i.e. physical installation of the components of hierarchy 200, consists primarily of connection of the EAs 30, 32, 34, 50, 52, 54, zone controllers 16, 56 and zone triggers 80, 82, 84 to the existing structure, as shown in FIG. 1.

Connection of the EAs 30, 32, 34, 50, 52, 54 may constitute the most labor-intensive step by virtue of the sheer number of EAs, which may be large for large institutions. However the difficulty of this installation is minimized by the fact that each EA can be installed essentially in three steps. First, a standard Cat5e cable (a specific form of connection 36 or 56—FIG. 1) is connected via its modular connector (e.g. RJ-45 plug) to the sole connector (e.g. RJ-45 jack) on the back side of the EA. Second, the Cat5e cable is strung through a hole in a wall in a prominent place where the EA is to be mounted, and its other end is connected to the relevant PoE switch 26 or 46, depending upon whether the EA is being installed in zone 1 or zone 2, respectively. Third, the EA is mounted to the wall surrounding the hole, e.g. using a strong adhesive or other attachment means to secure the back of the EA to the wall. The need to separately run a power cable to each device is eliminated by the fact that the device draws electrical power from the PoE switch over the Cat5e cable.

The zone controllers 16 and 56 may be rack-mountable devices that are installed by mounting in conventional 19" rack mounts. The devices are interconnected with their respective computer networks 14 and 44 in a conventional manner.

The zone triggers 80, 82 and 84 are installed in a similar fashion to the EAs, whose installation is described above, although the ZTs do not necessarily need to be connected to PoE switches. When not connected to a PoE switch, ZTs may be powered using a conventional power supply receiving A/C power by way of cord that is separate from the Cat5e cable through which computer network connectivity is achieved or by way of battery power for example.

Finally, the master controller software 72 is loaded onto computer 70, e.g. from a machine-readable medium 73 such as an optical disk, magnetic storage medium or other medium. The software 72 is configured with a list of zone controllers, identified by their unique IP addresses, that are to be controlled by the master controller 70 (i.e. all of the zone controllers in system 10). This is so that the master controller 70 will know the set of zone controllers from which it can expect to receive periodic zone reports and to which it may need to send de/activation commands (possibly right away, even before any zone report is received), should a trigger condition indicating an emergency situation be immediately detected upon system power-up. The installer then interacts with the master controller software 72 as described above in order to enter the MAC addresses of each EA and to assign a unique IP address to each EA. The installer also enters a "user-friendly" name for each EA that reflects its physical location, e.g. "Auditorium 1, Building 12". This user-friendly name is associated with the EA for future use in user notifications pertaining to that EA (e.g. "The EA in Auditorium 1, Building 12 has failed".).

As should now be apparent, installation of the system 10 is facilitated, and the amount of equipment to be installed is reduced, by the utilization of existing information technology infrastructure (networks, PoE switches, etc.) already in place at the institution within system 10 and by the fact that the added components easily interconnect with the existing infrastructure.

Operation of the system 10 occurs in two phases: initialization and steady-state operation. The initialization phase begins upon power up of the various added components whose installation was just described. The purpose of this phase is to establish the communication hierarchy 200 illustrated in FIG. 2. The nature of the initialization of each component depends upon its type.

Figure 4:
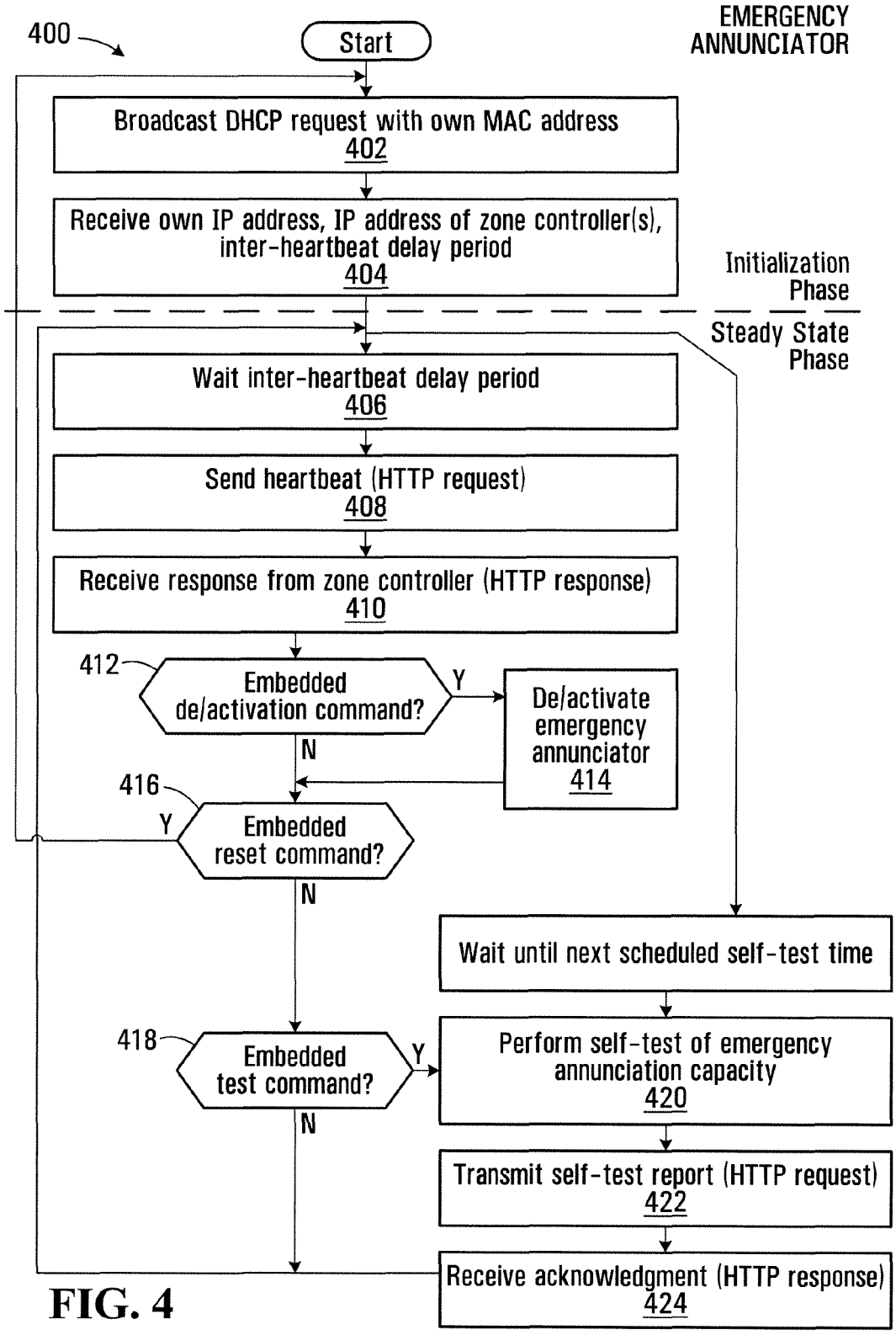
FIG. 4 is a flow chart illustrating operation of an exemplary emergency annunciator component of the system of FIG. 1.

Referring to FIG. 4, which illustrates the operation 400 of an exemplary emergency annunciator, the initialization phase is shown at 402 to 404. Initially, the EA, upon being powered up, broadcasts a DHCP query requesting information from the DHCP server (402, FIG. 4). The query includes the unique MAC address of the EA. This query is received at the DHCP server 60. Using the MAC address from the query, the DHCP server 60 performs a lookup within mapping 62 (FIG. 3) to identify a matching row in section 300, i.e. a row in which the column I MAC address matches the MAC address from the query. The DCHP server 60 then generates a response containing three pieces of information. The first piece of information is the IP address assigned to the querying EA device. This IP address is obtained from column II of the identified row of mapping 62. The second piece of information is the IP address of the parent zone controller for the querying EA device. This is so that the querying EA will know the address to which its periodic self-test reports should be sent. This IP address is obtained from column III of the identified row of mapping 62. The third piece of information is the inter-heartbeat delay period representing the amount of time that the EA should wait between successive heartbeat messages to its parent zone controller. This is obtained from row 352 of mapping 62 (FIG. 3). The response may also include additional information for possible use by the EA, such as the identity of the default gateway by which messages from the EA shall enter the nearest LAN/WAN (in accordance with conventional TCT/IP methodology), DNS servers that may be used to look up IP addresses associated with domain names assigned to parent zone controllers in some EA embodiments, and time servers that may be used to determine the current time in some EA embodiments, so that each EA in the system 10 can set itself to the same time (e.g. upon power-up and periodically thereafter). This response is transmitted back to the querying EA, where it is received (404, FIG. 4) and where both IP addresses are stored. The initialization phase for the EA is thus completed.

Figure 5A:
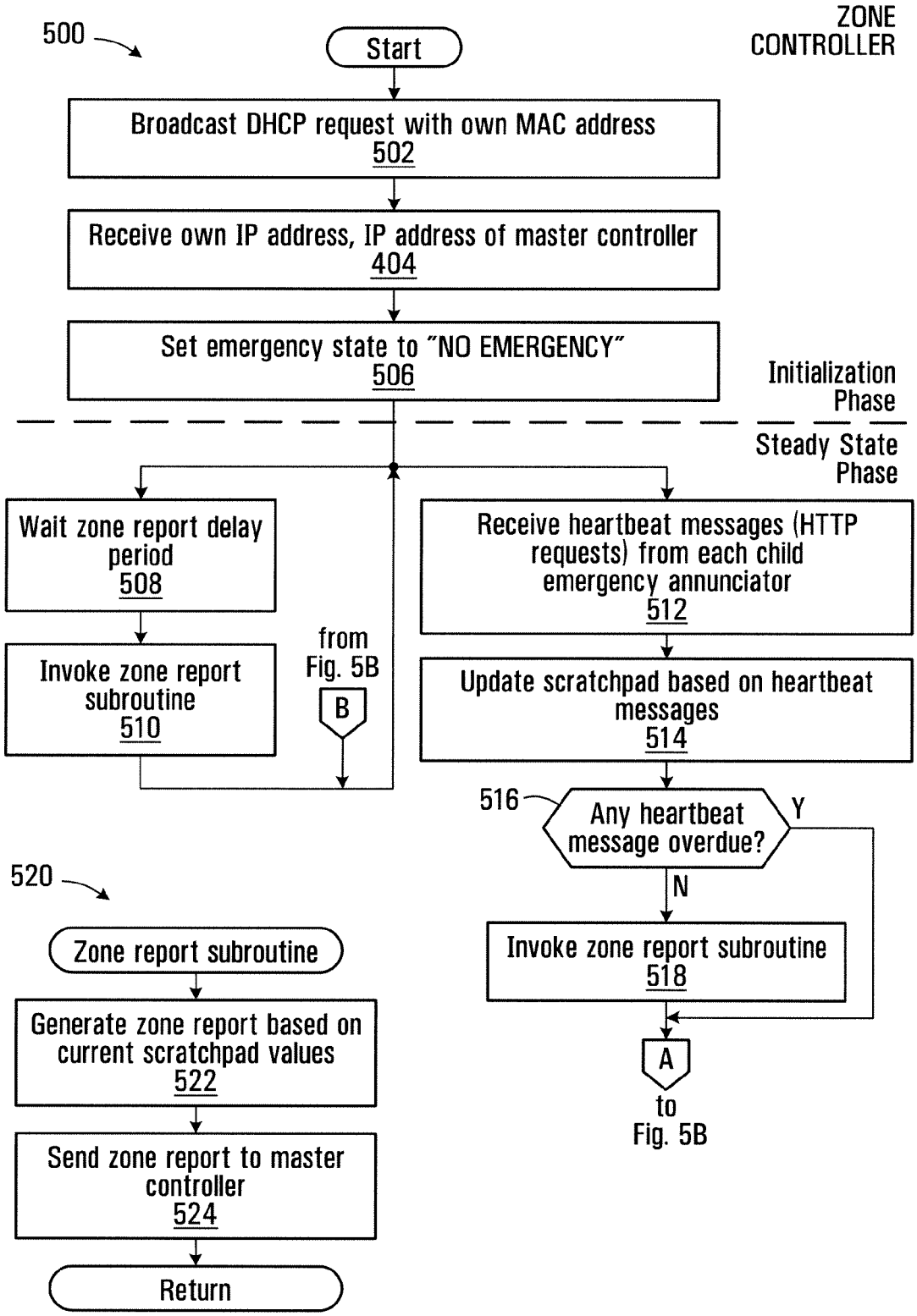
FIGS. 5A and 5B are a flowchart illustrating operation of an exemplary zone controller component of the system of FIG. 1.
Figure 5B:
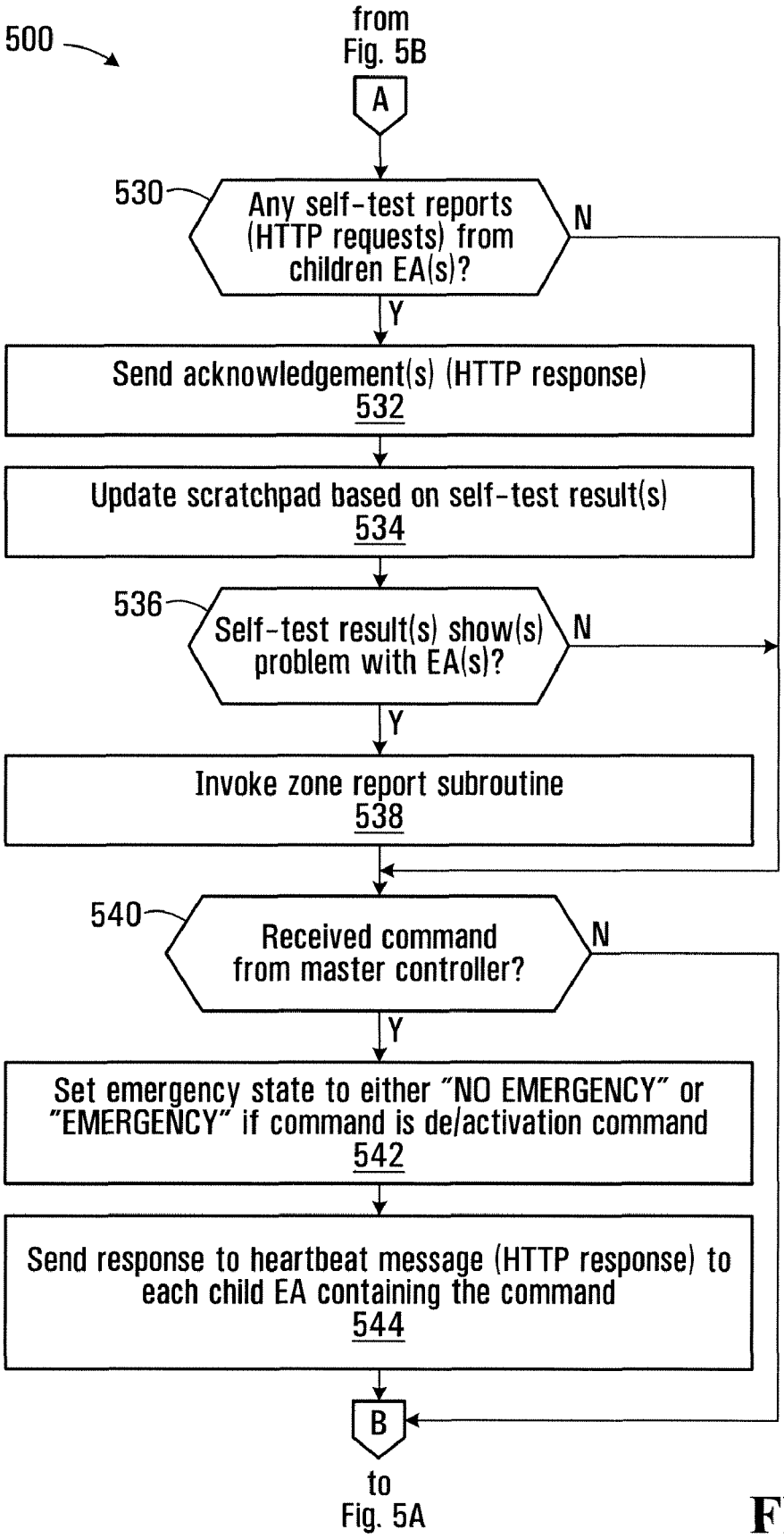

Turning to FIGS. 5A and 5B, operation 500 of an exemplary zone controller is illustrated. The initialization phase is shown at 502 to 506 in FIG. 5A. Upon power-up, the zone controller broadcasts a DHCP query, including its unique MAC address, requesting information from the DHCP server (502, FIG. 5A). Using the MAC address from the query, the DHCP server 60 performs a lookup within mapping 62 to identify a matching row in section 310. The DCHP server 60 then generates a response containing two pieces of information. The first piece of information is the IP address assigned to the querying zone controller, which is obtained from column II of the identified row. The second piece of information is the IP address of the master controller, which is obtained from column III of the identified row. This is so that the querying zone controller will know address to which its periodic zone reports should be sent. Finally, an emergency state indicator (e.g. a flag) maintained by the zone controller is set to "no emergency" to reflect an initial presumption that no state of emergency exists in the relevant zone, at least initially (506, FIG. 5A). The zone controller also opens TCP port 80 in preparation for the receipt of HTTP request messages from its children EAs (not expressly shown in FIG. 5A). The initialization phase for the zone controller is thus completed.

Figure 6:
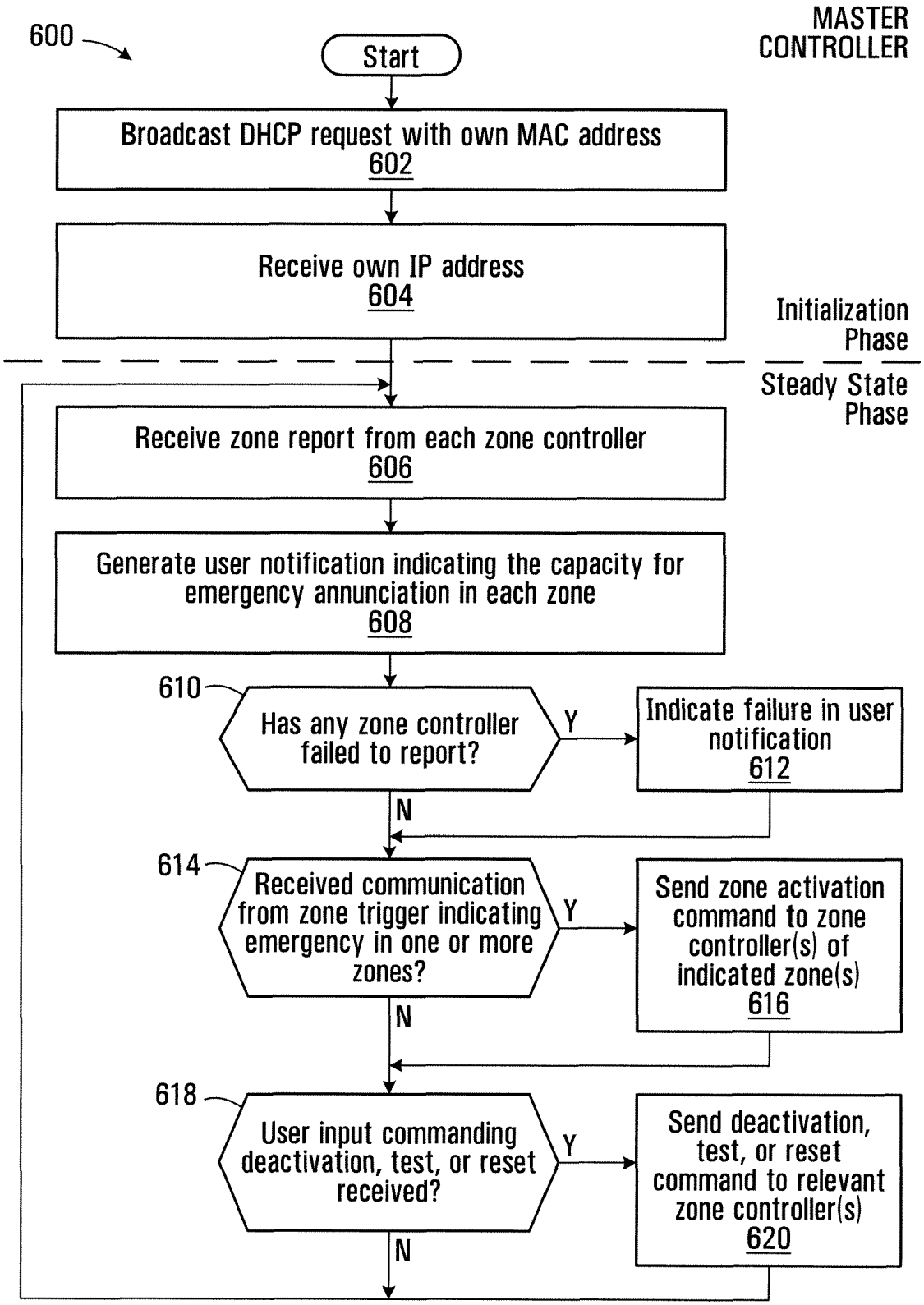
FIG. 6 is a flowchart illustrating operation of the master controller component of the system of FIG. 1.

Referring to FIG. 6, operation 600 of the master controller 70 is illustrated. The initialization phase is shown at 602 to 604. Upon power-up, the master controller broadcasts a DHCP query, including the unique MAC address of the master controller, requesting information from the DHCP server (502, FIG. 5). Using the MAC address from the query, the DHCP server 60 performs a lookup within mapping 62 to identify a matching row in section 340 (i.e. row 342). The DCHP server 60 then generates a response containing the IP address assigned to the master controller, which is obtained from column II of row 342. The initialization phase for the master controller is thus completed.

Although not expressly illustrated, zone triggers 80, 82 and 84 may also have an initialization phase, which may be similar to that of the EAs. That is, the zone triggers may broadcast a DCHP request with their MAC addresses and receive in return the IP address of their parent, which in this case is the master controller 70.

Earlier it was noted that, in one aspect, the software executed by each zone controller is tantamount to world wide web server configured to provide information specific to each of its children EAs upon request. It should be appreciated that, as a consequence of this implementation following the initialization phase, it is possible to verify whether communication could exist between an EA and its parent zone controller by verifying that a browser executing at a network device on the same computer network as the EA can "see" a web server collocated with the zone controller. If so, then the communication channel is validated. This might be achievable even in the absence of the EA and the zone controller.

The steady-state operation phase for system 10 begins after the initialization phase has completed. The operation of each component during this phase is specific to its type.

Referring again to FIG. 4, the steady-state operation phase of an exemplary emergency annunciator is shown at 406 to 424. This phase comprises two threads of execution which are effectively executed in parallel. The first thread is represented by operation at 406 to 424 (excluding 419). The second thread is represented by operation at 419, 420, 422, and 424. Operation at 420, 422, and 424 is common to both threads.

Beginning with the first thread, initially the EA waits the inter-heartbeat delay period (406). This delay period is 15 seconds in the present embodiment (as shown in FIG. 3, row 352), but it may be longer or shorter in alternative embodiments. The delay period is the period of time between successive iterations of the loop defined by first thread of operation at 406 to 424 of FIG. 4. Accordingly, it should be appreciated that the delay period defines the maximum lag time between the parent zone controller receiving instructions from the master controller to annunciate an emergency within its zone and the annunciation of the emergency by the EA (discounting network propagation delays between the zone controller and EA as well as processing time at the zone controller and EA, and discounting the possibility of an earlier, previously scheduled self-test occurring within the second thread, as described below, which may cause earlier emergency annunciation).

Next, the EA sends a predetermined ("canned") heartbeat message to the parent zone controller, using the IP address of the zone controller obtained during the initialization phase (408, FIG. 4). The heartbeat message is encrypted for security, using a lightweight public/private key encryption. The encrypted content forms the payload of an HTTP request message, which acts as the vehicle for transmitting the report to the zone controller. The message is similar to an HTTP request message that might be generated by a world wide web browser application when a hyperlink is clicked by a user. The rationale for the EA's use of an HTTP request message for initiating communication with its parent zone controller is that the EA may be situated behind a firewall (e.g. router/firewall 22 of zone 1 or router/firewall 42 of zone 2) while the parent zone controller is situated outside of the firewall (e.g. zone controllers 16 and 56 of zones 1 and 2 respectively). Firewalls conventionally allow such "outgoing" HTTP request messages to pass via TCP port 80 and they also permit "incoming" responses to the HTTP request messages to pass in the opposite direction. If it were not so, world wide web pages requested from within firewall-protected corporate networks could not be received by their requester. Thus the HTTP request/response message approach ensures that, if there is a firewall between the parent zone controller and its EA (as is the case in zone 1 of FIG. 1—see router/firewall 22), the firewall will not hinder communications from the zone controller to its child. For clarity, it is noted that communication through the other router/firewall in zone 1 of FIG. 1, namely router/firewall 12, is not problematic as it has been configured to permit HTTP request messages to pass through towards the zone controller 16.

Even if no firewall happens to be interposed between a zone controller and its children EAs (e.g. as in zone 2 of FIG. 1), the "HTTP request/response" communication approach will nevertheless function. Thus adoption of the approach relieves the installer from the burden of having to consider, during installation of emergency warning system 10, whether or not a firewall is interposed between each zone controller and its children EAs.

In the present embodiment, the HTTP request message uses XMLRPC formatted message bodies. The specification for XMLRPC is available at www.xmlrpc.com/spec, and is hereby incorporated by reference hereinto.

An HTTP response is thereafter received from the parent zone controller (412, FIG. 4) responsive to the heartbeat message. The response contains an encrypted payload containing a command from the zone controller, that may be one of a number of commands.

If the zone controller is currently commanding activation of emergency annunciation in accordance with instructions from the master controller 70, the embedded command will be an activation command. This may either represent an initial command to activate emergency annunciation (i.e. "turn on") or a repeated command to continue annunciating an emergency for which emergency annunciation was earlier commenced (i.e. "stay on"). Alternatively, if the zone controller had been instructed by the master controller 70 to deactivate emergency annunciation, the embedded command may be a deactivation command. The deactivation command may either represent an initial command to deactivate emergency annunciation (i.e. "turn off") or a repeated command to maintain deactivated emergency annunciation (i.e. "stay off") . The rationale for sending "stay on" and "stay off" commands is to ensure that the EA assumes the proper state should the original "turn on" or "turn off" commands be lost in transmission to the EA. It will be appreciated that "stay on" and "stay off" commands are identical to "turn on" and "turn off" commands (respectively).

If an activation or deactivation command has been received (412, FIG. 4), the LEDs spelling "LOCK DOWN" are illuminated or turned off, as the case may be (414). When the text is illuminated, the brightness of the LEDs is varied sinusoidally over a period of approximately 5 seconds. This is done for two reasons. First, the resulting "soft-strobing" effect will serve to catch the eye of human observers. Second, readability of the text from different distances or in dark or smoke-filled environments is promoted because, for each human observer, the brightness of the text will be suitable for reading at some point during the period. If a deactivation command has been received, the LEDs are turned off.

If, on the other hand, the command is a reset command (416), operation reverts to the initialization phase at 402. The reset command is typically sent when something within the mapping 62 has changed (e.g. the inter-heartbeat delay period 352, FIG. 3) and it is desired for each EA to be forced to retrieve its new configuration settings, including the new delay period, by repeating operation at 402 and 404.

If the command is a test command (418), then the EA performs a self-test of its capacity to annunciate an emergency (420). This self-test constitutes a "command" self-test, which may or may not occur above and beyond the scheduled self-tests that are independently performed by each EA (described below). In the present embodiment, the self-test is a continuity check of the multiple LEDs within the EA that are connected in series to spell out the words "LOCK DOWN". This type of self-test may be considered to be conservative, in that failure of just one LED may cause a negative self-test result. The rationale for such a conservative self-test is that, because failure of even one LED might cause the textual indicator "LOCK DOWN" to be misinterpreted by a human observer, such a failure cannot be tolerated. Alternative embodiments could employ a self-test that is less conservative (e.g. failure of more than 5% of LEDs connected in a matrix arrangement would be required for the self-test to be negative).

Thereafter, a report of the self-test result, encrypted for security, is generated and transmitted to the parent zone controller, using the HTTP request message format described above (422, FIG. 4). An HTTP response is thereafter received from the parent zone controller containing acknowledgement of the message (424). Operation then repeats from 406.

Turning to the second thread, the EA waits until a predetermined, scheduled self-test time (419). For example, it may be specified that a self-test should occur, independently of what is happening in the first thread, at 2:00 AM every day. This may be to avoid drawing attention to the brief illumination of the LEDs which may occur during the self-test.

Although not necessarily expressly described above, the scheduled self-test time may be communicated to the EA by the DCHP server 60 during the initialization phase, in a similar fashion to the inter-heartbeat delay period (e.g. it may also be specified in mapping 62). At the scheduled time, the test is performed and the result is communicated to the zone controller per 420, 422 and 424 of FIG. 4, as described above. Operation then repeats at 419.

Referring to FIGS. 5A and 5B, the steady-state operation phase of an exemplary zone controller is shown at 508 to 544. This phase also comprises two threads of execution which are effectively executed in parallel. The first thread is represented by operation at 508 to 510 of FIG. 5A. The second thread is represented by operation at 512 of FIG. 5A to 544 of FIG. 5B. Operation 520 (FIG. 5A) represents a subroutine that may be triggered by either thread.

Beginning with the first thread, initially the zone controller waits delay period (508) between zone reports. This delay period, which is 1 hour in the present embodiment but may be longer or shorter in alternative embodiments and/or may be user-configurable, represents the amount of time between successive zone reports from a zone controller to the master controller 70 absent any detected problems that may trigger an earlier report (as described below).

Operation of the second thread will be described first. Initially, the zone controller receives heartbeat messages, in the form of HTTP requests (as described above), from each of its children EAs (512, FIG. 5A). Based on the heartbeat messages, a scratchpad maintained by the zone controller is updated (514). The scratchpad is an area of memory within the zone controller that represents the latest information regarding the status of each child EA of which the zone controller is aware. The scratchpad is continuously updated during zone controller operation. An exemplary scratchpad that may be maintained by zone controller 16 of FIG. 1 is illustrated in FIG. 7A.

Referring to FIG. 7A, scratchpad 700 is illustrated in table form at a first time 125 (represented as seconds elapsed since a start time). It will be appreciated that the titles and column headings of the table in FIG. 3 are to facilitate reader comprehension and do not actually appear within the scratchpad 700. Each row within the scratchpad 700 represents a child EA of which the zone controller 16 is aware. The three EAs 30, 32 and 34 of FIG. 1 are represented as rows 710, 712 and 714 of FIG. 7A, respectively. The table has four columns I-IV. Column I uniquely identifies the EA (this may actually be a unique MAC address or IP address of the EA, however the reference numeral of FIG. 1 is indicated in FIG. 7A to facilitate comprehension). Column II represents a time (again, in seconds form the start time) at which the last heartbeat message was received from the relevant EA. Column III represents the current emergency annunciation status of the relevant EA, as echoed back by the EA as part of its self-test report to confirm current emergency annunciation status (1 indicating that the LEDs are on, 0 indicating that the LEDs are off). Column IV represents the status of various possible alarm conditions at the relevant EA. Column IV is broken into a series of sub-columns, each representing a particular alarm condition that may exist at the EA (e.g. an over or under voltage situation, an over or under current situation, and so forth). Values of 0 and 1 in each sub-column indicate whether or not the alarm is currently active (respectively). Values of 1 in any of the sub-columns of column IV and unexpected values in column III are considered to be problematic self-test results. These values are set based on self-test reports periodically received from each of the EAs. The information within columns III and IV represent a consolidation of the latest self-test results from all of the children EAs.

Referring to FIG. 7B, the same scratchpad 700 is shown but at a later time (136 seconds since the start time). Bold values in FIG. 7B indicate values that have changed from FIG. 7A. It will be appreciated that the updated times in column II of rows 710 and 712 (FIG. 7B) reflect the fact that new heartbeat messages have been received from EAs 30 and 32 since time 125. In contrast, the time in column II, row 714 of FIG. 7B is unchanged because no heartbeat message has been received from EA 34 since time 125 (each EA sends a heartbeat message every 15 seconds, but the 15-second interval is not necessarily aligned as between EAs). The updated value in column III, row 710 indicates that a self-test report was received since time 125 indicating that emergency annunciation status is now on.

It should be appreciated that, early in the operation of the steady-state phase of FIG. SA, the zone controller grows scratchpad 700 row-by-row as reports are received for the first time from EAs. That is, the zone controller assumes that, when an EA sends it an HTTP request message representing a heartbeat or self-test result for the first time, it is proper to consider that EA to be a child of that zone controller. Thus a new row representing that EA is created in scratchpad 700. This facilitates the addition of new EAs at a later time.

Referring back to FIG. 5A, if any heartbeat messages are overdue (516), the zone report subroutine 520 is invoked (518). A heartbeat message may be considered overdue if more than N inter-heartbeat delay periods have elapsed without a heartbeat message from the EA (where N is a user-configurable integer). This operation reflects the fact that, when a problem is detected with one or more EAs, a zone report is triggered right away. This is referred to as a "priority" zone report, as it is sent only when necessary (i.e. when a problem is detected). This is above and beyond the zone report that is sent at regularly scheduled intervals in the absence of any problems, as described below. In the present embodiment, the substance of the zone reports is the same regardless of whether it is a priority report or a regularly scheduled report.

Referring to subroutine 520, a zone report is generated based on the current scratchpad values (522, FIG. 5A). The zone report constitutes a snapshot of the current scratchpad values. Then, the zone report is transmitted to the master controller 70 (524, FIG. 5A). It will be appreciated that transmission by the zone controller of a single zone report consolidating the numerous reports from the various children EAs reduces network traffic with the master controller, as compared with merely relaying the reports for example.

Referring to FIG. 5B, if any self-test reports (in the form of HTTP request messages) have been received from any of the children EAs (530), e.g. as a result of the independent execution of regularly scheduled self-tests, the zone controller sends an acknowledgement message (HTTP response) back to the EA(s) to confirm receipt (532). Then any necessary updates to scratchpad values in columns III and IV (FIGS. 7A, 7B) are made based on the self-test report(s) (534, FIG. 5B). If the self-test report(s) reflect(s) any problems with the EA(s) (536), then the zone report subroutine 520 is invoked in order to cause a priority zone report to be transmitted to the master controller (538), as previously described.

At any time, the zone controller may receive a command issued to it by the master controller 70 (540, FIG. 5B). The command may be a zone activation command (i.e. "tell all EAs in your zone to turn on"), a zone deactivation command (i.e. "tell all EAs in your zone to turn off"), a reset command (i.e. "tell all EAs in your zone to reset themselves"), or a test command (i.e. "tell all EAs in your zone to execute a self-test"). If the command is a zone activation command or a zone deactivation command, the emergency state flag is set accordingly (542, FIG. 5B). Thereafter, for each child EA, an HTTP response to the most recently received HTTP request message received from the EA is generated and sent, containing the command that was received from the master controller 70 (544). In this manner, the command most recently received from the master controller is propagated to all of the children EAs. Operation then repeats from 512 (FIG. 5A).

Turning to the first thread of FIG. 5A, this thread is responsible for generating and sending a zone report to the master controller at a regularly scheduled interval. Initially the zone controller waits delay period (508) between zone reports. This delay period, which is 1 hour in the present embodiment but may be longer or shorter in alternative embodiments and/or may be user-configurable, represents the amount of time between successive zone reports from a zone controller to the master controller 70 absent any detected problems that may trigger an earlier report (as described below).

Thereafter, the zone report subroutine 520 is invoked (510), as previously described. Operation of the first thread thereafter repeats from 508.

Referring to FIG. 6, the steady-state operation phase of the master controller is shown at 606 to 616. Initially, the master controller receives zone reports from each zone controller (606). Based on the received zone reports, the master controller generates a user interface screen (a form of user notification) providing an "at a glance" indication of the capacity for emergency annunciation in each zone (608). For example, a grid for each zone in which each cell represents an EA could be displayed, with the color of each cell reflecting the status of the EA (green for OK, red for alarm condition active, etc.). Alternatively, or in conjunction, the user notification take the form of an email or SMS messages that is transmitted to one or more predetermined recipient addresses. The transmission of the email or SMS message may be contingent upon the existence at least one problem within at least one zone, to avoid inundation of the recipient's inbox with an overabundance of messages. The master controller 70 may need to be pre-programmed with a gateway mail server's IP address to facilitate email notification. The user notification may include the user-friendly name associated with any EAs experiencing problems.

If any zone controller has failed to send a zone report (610), it is considered that either the zone controller or the communication channel between the zone controller and the maser controller has failed. In this case, the failure is indicated in the user notification (612). Advantageously, if the user notification shows that any of the EAs or zone controller have failed, remedial action may be taken immediately, so that the system 10 can be restored to proper operating condition prior to the occurrence of an emergency.

If the zone controller has received a communication from any of the zone triggers indicating that an emergency is to be annunciated within one or more zones (518), an activation command is composed and transmitted to the relevant zone controller(s) (616).

If user input has been received at the master controller 70 indicating that the user is commanding the zone to deactivate emergency annunciation, test, or reset all of its EAs (618), a command to that effect is sent to the relevant zone controller (s) (620). Operation 600 then repeats from 606.

Although not expressly illustrated in FIG. 6, the master controller 70 also receives periodic heartbeat from each of zone triggers 80, 82 and 84. Absence of a heartbeat signal for a predetermined time triggers a user notification reflecting this fact (e.g. by updating the user interface screen and/or sending an email or SMS message indicative of the problem). This is so that remedial action may be taken if necessary. In the result, confidence in the ability of each zone trigger to reliably communicate a trigger condition to the master controller 70 is provided.

If it is desired to upgrade the system 10 by adding new EAs at a later date, this may be easily accomplished. All that is required is to add a new row for each new EA in section 300 of mapping 62 and to physically install the EAs as earlier described.

As will be appreciated by those skilled in the art, modifications to the above-described embodiment can be made without departing from the essence of the invention. For example, although the EAs are described herein as annunciating an emergency by illuminating text (i.e. visually), other methods of emergency annunciation, such as providing acoustic notifications (e.g. a siren or pre-recorded speech), could be used. An acoustic notification may be advantageous in that emergency annunciation may still be effective even when the EA is visually obscured from occupants of the premises, e.g. by smoke.

An exemplary alternative emergency warning system may incorporate one or more "acoustic EAs" (i.e. EAs providing acoustic notification of an emergency), possibly in the same system as the earlier-described EAs 30, 32, 34, 50, 52 and 54 ("visual EAs"). In one embodiment, acoustic EAs may be largely similar to visual EAs, differing in only three respects.

Firstly, exemplary acoustic EAs incorporate a loudspeaker or other form of electro-acoustical transducer for converting an electrical signal to sound (i.e. for playing the acoustic notification). The electro-acoustical transducer can either take the place of, or can supplement, illuminable text. Combining acoustic notifications (sound) with visual notifications (illuminable text) in a single EA may be considered to maximize the likelihood of occupant awareness of an emergency situation. However, it is not necessary to provide both forms of notification. Moreover, some EAs within a zone could be visual EAs while others could be acoustic EAs.

In one embodiment of an acoustic EA, the EA's processor may output a Pulse-Code Modulated (PCM) digital signal, e.g. a digital audio recording such as a .WAV file. The PCM signal may conform to the $I^2S$ electrical serial bus interface standard (also referred to as Inter-IC sound or Integrated Interchip Sound). The PCM signal may in turn be converted to analog by a digital-to-analog converter (DAC), and the resulting analog signal may be passed through a reconstruction filter. The purpose is to band-limit the signal from the DAC to prevent aliasing. The cut-off frequency may be dependent on the sampling frequency of the data sent to the DAC (e.g. 8 khz sample rate should have a cut-off frequency of less than 4 khz for telephone quality sound). The output of the reconstruction filter may then be amplified by an amplifier before being converted to audible sound by the electro-acoustical transducer. Other acoustic EA embodiments may have different designs.

Secondly, acoustic EAs that are capable of playing pre-recorded speech (which does not necessarily include all acoustic EA embodiments—some may simply activate a siren or provide another form of acoustic notification) may be equipped with more memory (e.g. RAM or Flash memory) than a visual EA. This is to permit storage of digital audio recordings (e.g. .WAV files), which may be sizeable. In an exemplary embodiment, the capacity of storage memory may be sufficient for storing two different digital audio recordings: one indicative of an emergency situation (e.g. "This building is now in lockdown . . . remain in your current location until further notice") and another indicative of an end to the emergency situation (e.g. "Lockdown cancelled . . . please resume your normally scheduled activities."). The use of two separate recordings is not absolutely required in all embodiments however. For example, only a subset of the two recordings, or neither of them, may be stored in some embodiments, with the other emergency state(s) being indicated by predetermined sounds such as sirens, bells, musical tones or the like.

It is noted that, when an acoustic EA plays a digital audio recording to annunciate an emergency responsive to an activation command, the recording is typically (although not necessarily) played repeatedly until the emergency ends. This is in order to provide occupants of the premises with ample opportunity to hear the recorded message. For example, upon receipt of an activation command, an acoustic EA may repeatedly play its stored digital audio recording indicative of an emergency situation. Later, upon receipt of a deactivation command, the acoustic EA may repeatedly play another stored digital audio recording indicative of an end to the emergency situation, possibly for a predetermined number of times (e.g. five times).

Thirdly, each exemplary acoustic EA may incorporate a feedback circuit for sensing a level of an electrical signal (e.g. electrical current) driving the electro-acoustical transducer for use during the EA's periodic self-tests. In particular, rather than effecting a continuity test of an circuit comprising lighting elements (as the visual EA does), an acoustic EA may output predetermined test acoustic indicator (e.g. a tone or chirp) and, as that indicator is being output, sample the electrical signal an input of the electro-acoustical transducer, e.g. via an analog-to-digital converter (ADC). In this way, the feedback circuit can be used to confirm that the transducer is being driven in a manner that will result in the expected audible sound, assuming that the transducer is operational. The predetermined test acoustic indicator may for example be a tone of a particular frequency and amplitude. The tone may be limited in duration to avoid attracting attention and/or may be preceded with the playing of a pre-recorded message, e.g. "the following is a test of the emergency warning system—this is only a test.". The sensing of the input of the electro-acoustical transducer may entail sampling of the electrical current at a frequency that is at least two times the frequency of the test tone being generated, in accordance with Nyquist's sampling theorem, to confirm that the output frequency of the tone is as expected. The amplitude of the signal may also be confirmed. The EA's status, as indicated in the self-test report that is periodically generated by the EA, may be based on these confirmations.

In some embodiments, it may be possible to dynamically reconfigure acoustic EAs with new digital audio recordings after the system 10 has been installed in order to customize the acoustic notifications provided in one or more zones. For example, in some embodiments, the master controller 70 may allow its user to specify a digital audio recording (e.g. .WAV file) representing a new acoustic notification to be provided as well as the identity of the zone(s) to which the recording is to be downloaded (e.g. a subset of the totality of zones). To configure the EAs of the selected zones with the new recording, the .WAV file may initially be communicated from the master controller 70 to the zone controller of each specified zone using conventional file transfer techniques. Once a zone controller has received such a .WAV file, when responding to each acoustic EA's heartbeat message (FIG. 5, 544), the zone controller may alert the acoustic EA to the existence of a new .WAV file to be downloaded. Thereafter, logic at each acoustic EA may circumvent the normal waiting of the inter-heartbeat delay period (FIG. 4, 406) in favor of immediately sending heartbeat messages to the zone controller. The first heartbeat message effectively apprises the zone controller that the EA is ready to receive the new .WAV file. In response to the first heartbeat message, the zone controller may send a first chunk of the .WAV file to the EA. The file may be sent in chunks rather than as a unit in view of its size, in order to avoid monopolizing the zone controller in such a way that might result in dropped communications with other EAs. The EA receives the chunk, stores it, and immediately responds with a further heartbeat message effectively requesting the next chunk (if the previous chunk was received intact) or requesting retransmission of the previous chunk (if the previous chunk was not received intact). This continues until the .WAV file has been fully communicated to the EA and the EA confirms receipt of all of the chunks. At this stage, the EA will have assembled the chunks into the new .WAV file that takes the place of the previous .WAV file. This new .WAV file will thereafter be played instead of the previous file, should an activation command be received. In the meantime, the EA resumes normal sending of heartbeat messages at the predetermined inter-heartbeat delay interval.

It should be appreciated that, in any of the above-described embodiments, the number of zones can vary (e.g. only one, more than two, etc.). Moreover, multiple zone controllers per zone may be used, e.g. in the case where a zone is very large and has a large number of EAs to be controlled. For example, if each zone controller is configured so as to be able to control only up to a "subnet" worth of EAs (i.e. 255 EAs) and the number of EAs within a zone exceeds this number, use of another zone controller for that zone may be necessary. Within mapping 62, each of the multiple zone controllers assigned to a zone can be designated as the parent of only a subset of the EAs of the zone.

The network addresses used to uniquely identify each component in mapping 62 may be something other than IP addresses. For example, unique domain names could be used. In this case, each EA may be capable of interacting with a DNS server (whose identity may be provided by the DHCP server 60) in order to determine the IP address corresponding to each domain name.

The zone triggers 80, 82 and 84 need not be hardware zone triggers that are wired into a network such as LAN 74. The zone triggers 80, 82, and 84 could be implemented in software, e.g. as part of the master controller software 72. Indeed, the capacity for triggering emergency annunciation in one or more zones from the master controller software 72 may exist despite the installation hardware zone triggers 80, 82 and 84. The software triggers would provide an alternative mechanism for triggering emergency annunciation. Alternatively, zone triggers 80, 82 and 84 could be wireless devices, e.g. implemented as devices with 802.11(a/b/g/n) client connectivity and powered from a nearby A/C outlet. Assuming that the local area supplies a connection to the "wired" network through a wireless access point, then each zone trigger could maintain data communication with the system 10 similar to that described above through that connection. All other aspects of the functionality of the ZT could be as described above.

In the above-described embodiment, each zone trigger communicates directly to the master controller. In alternative embodiments, each zone trigger may instead communicate directly with the zone controller(s) of the zone(s) that it is responsible for activating when its button is pressed. Mapping 62 would need to be updated to reflect this alternative hierarchy. The scratchpad maintained by the zone controller(s) may be updated with a new row to represent the zone trigger, with the periodic heartbeat messages from the zone trigger being indicated therein in much the same way as is done for the EAs. Overdue heartbeat messages from the zone trigger could similarly trigger a priority zone report from the zone controller to the master controller. When a zone trigger sends a message representing the pressing of its button to the zone controller, the zone controller would need to quickly communicate this trigger condition to the master controller in addition to activating all of its children EAs in the manner described above.

In some embodiments, it may be possible to use switches in place of PoE switches 26, 46 that do not conform to the PoE standard. These may be regular network switches having external PoE injector components. The injector(s) may perform the job of combining the power with the data before it enters the cable span destined for the EA, on a port by port basis.

In the embodiment described above, the IP address of the master controller is set in mapping 62 and is thereafter disseminated to various system components (including the master controller) by DHCP server 60. In alternative embodiments, the master controller 70 may have a predetermined, fixed IP address with which it is pre-programmed. In such cases, section 340 (including row 342) of FIG. 3 could be omitted from mapping 62, and master controller 70 would not need to engage in any processing for determining its IP address. System components such as zone controllers and zone triggers could be pre-programmed to use the fixed IP address in communicating with master controller 70.

Other modifications will be apparent to those skilled in the art and, therefore, the invention is defined in the claims.

What is claimed is:

1. An emergency warning system comprising:

a plurality of emergency annunciators for installation in a physical zone, each of said emergency annunciators being operable to independently and periodically perform a self-test for verifying its capacity to annunciate an emergency and to transmit a report of the self-test result;

a zone controller in communication with each of said emergency annunciators, said zone controller being operable to receive said reports from each of said emergency annunciators and to generate and transmit a zone report representing a consolidation of the received reports, said zone controller further being operable to receive a zone activation command from a master controller and to transmit, responsive thereto, an activation command to each of said emergency annunciators; and the master controller in communication with said zone controller, said master controller being operable to receive said zone report from said zone controller and to generate therefrom a user notification indicative of the self-test results, said master controller further being operable to transmit said zone activation command in response to a trigger condition.

2. The emergency warning system of claim 1 wherein said plurality of emergency annunciators is a first plurality of emergency annunciators, said geographical zone is a first geographical zone, said zone controller is a first zone controller, and said zone activation command is a first zone activation command, and further comprising:

a second plurality of emergency annunciators for installation in a second physical zone; and a second zone controller in communication with each of said second plurality of emergency annunciators and with said master controller, said second zone controller being operable to receive a second zone activation command from said master controller and to transmit, responsive thereto, an activation command to each of said second plurality of emergency annunciators, wherein said master controller is further operable to selectively transmit said first zone activation command or said second zone activation command based upon said trigger condition.

3. The emergency warning system of claim 2 wherein said trigger condition comprises receipt by said master controller of a communication indicating that an emergency exists in either or both of said first physical zone and said second physical zone.

4. The emergency warning system of claim 3 further comprising a trigger device operable to transmit said communication to said master controller over a computer network responsive to user input.

5. The emergency warning system of claim 1 wherein each of said emergency annunciators is operable to transmit said report of the self-test result to said zone controller over a computer network.

6. The emergency warning system of claim 5 wherein each of said reports transmitted by an emergency annunciator comprises a HyperText Transfer Protocol (HTTP) request message and wherein said activation command transmitted to each of said emergency annunciators comprises a response to said HTTP request message, such that the zone controller is operable to activate the emergency annunciators by way of the respective activation commands even when the emergency annunciators are behind a firewall while the zone controller is outside of the firewall.

7. The emergency warning system of claim 5 wherein each of said emergency annunciators is an electronic device having only one external connector for connection to said computer network and wherein said electronic device is powered by electrical power drawn from said computer network using said connector.

8. The emergency warning system of claim 7 wherein said network is an Ethernet network and wherein said powering of said electronic device is according to the Institute of Electrical and Electronics Engineers (IEEE) 802.3af Power over Ethernet (PoE) standard.

9. The emergency warning system of claim 5 further comprising a network address server operable to communicate a network address of said zone controller to each of said emergency annunciators for use in transmitting said reports of said self-test results.

10. The emergency warning system of claim 1 wherein each of said emergency annunciators comprises illuminable text and wherein said activation command causes said text to illuminate.

11. The emergency warning system of claim 10 wherein said illuminable text comprises a circuit with a plurality of lighting elements connected in series and wherein said self-test comprises verifying the continuity of said circuit.

12. The emergency warning system of claim 1 wherein each of said emergency annunciators comprises an electro-acoustical transducer and storage memory storing a digital audio recording indicative of an emergency situation and wherein said activation command causes the emergency annunciator to repeatedly convert said digital audio recording to audible sound using said electro-acoustical transducer.

13. The emergency warning system of claim 12 wherein said self-test comprises, at said emergency annunciator:

generating an electrical signal representative of a predetermined test acoustic indicator for application to said electro-acoustical transducer;

via a feedback circuit, sensing an electrical signal at an input of said electro-acoustical transducer; and based on said sensing, confirming that said generated electrical signal is reaching said electro-acoustical transducer.

14. The emergency warning system of claim 12 wherein said master controller is further operable to transmit a zone deactivation command, wherein said zone controller is further operable to receive said zone deactivation command from said master controller and, responsive thereto, to transmit a deactivation command to each of said emergency annunciators, wherein said storage memory of each of said emergency annunciators stores a further digital audio recording indicative of an end to said emergency situation, and wherein said deactivation command causes the emergency annunciator to repeatedly convert said further digital audio recording to audible sound using said electro-acoustical transducer.

15. The emergency warning system of claim 1 wherein said generating of said zone report comprises, upon failure of said zone controller to receive a report from one of said emergency annunciators for at least a predetermined time period, generating an indication of said failure.

16. The emergency warning system of claim 1 wherein said master controller is further operable to, upon failure to receive said zone report for at least a predetermined time period, generate a user notification of said failure.

17. In a computer network comprising a switch capable of switching network traffic and of providing electrical power for powering network devices connected to said switch, a method of installing an emergency warning system, the method comprising:

plugging each of a plurality of emergency annunciators into said switch, each of said emergency annunciators being an electronic device operable to annunciate an emergency in response to an activation command received over said computer network via said switch and to independently and periodically perform a self-test for verifying its capacity to annunciate an emergency and to transmit a report of the self-test result over said computer network via said switch, said electronic device to be powered by electrical power provided by said switch;

connecting a zone controller for controlling said plurality of emergency annunciators to said computer network or to another computer network in communication with said computer network, said zone controller operable to receive said reports from each of said emergency annunciators and to generate and transmit a zone report representing a consolidation of the received reports, said zone controller further being operable to receive a zone activation command from a master controller and to transmit, responsive thereto, an activation command to each of said emergency annunciators; and activating the master controller for controlling said zone controller, said master controller being connected to said computer network or to another computer network in communication with said computer network, said master controller being operable to receive said zone report from said zone controller and to generate therefrom a user notification indicative of any problematic self-test results, said master controller further being operable to transmit said zone activation command in response to a trigger condition.

18. The method of claim 17 further comprising:

storing in memory of a network device accessible by said plurality of emergency annunciators over said computer network a mapping between each of said plurality of emergency annunciators and said zone controller, said mapping for use in configuring each of said emergency annunciators for transmitting said reports.

19. The method of claim 18 further comprising:

configuring said mapping by specifying unique network addresses for each of said plurality of emergency annunciators and said zone controller.

20. The method claim 17 wherein the plurality of emergency annunciators is installed behind a firewall, wherein the zone controller is outside of the firewall, wherein each of the reports transmitted by an emergency annunciator comprises a HyperText Transfer Protocol (HTTP) request message, and wherein the activation command transmitted to each of the emergency annunciators comprises a response to the respective HTTP request message, such that the zone controller is operable to activate the plurality of emergency annunciators by way of the activation commands despite the fact that the plurality of emergency annunciators is installed behind the firewall while the zone controller is outside of the firewall.

21. The emergency warning system of claim 5 wherein each of said reports transmitted by an emergency annunciator comprises a HyperText Transfer Protocol (HTTP) request message and wherein said activation command transmitted to each of said emergency annunciators comprises a response to said HTTP request message, such that the zone controller is operable to activate the emergency annunciators by way of the respective activation commands regardless of whether the emergency annunciators are installed behind a firewall while the zone controller is outside of the firewall.

* * * * *